US006923366B2

(12) United States Patent
Lo Duca

(10) Patent No.: US 6,923,366 B2
(45) Date of Patent: Aug. 2, 2005

(54) BOX WITH POCKET FOR EXTRACTABLE LEAFLET

(75) Inventor: Carmelo Lo Duca, Milan (IT)

(73) Assignee: GI.BI. EFFE S.r.l., Milan (IT)

( * ) Notice: Subject to any disclaimer, the term of this patent is extended or adjusted under 35 U.S.C. 154(b) by 89 days.

(21) Appl. No.: 10/449,213

(22) Filed: Jun. 2, 2003

(65) Prior Publication Data

US 2003/0226880 A1 Dec. 11, 2003

(30) Foreign Application Priority Data

Jun. 10, 2002 (IT) ..... MI2002A1267

(51) Int. Cl.[7] ..... B65D 5/486
(52) U.S. Cl. ..... 229/120.18; 206/232; 229/123
(58) Field of Search ..... 229/123, 153, 229/120.08, 120.15, 120.18; 206/232, 831

(56) References Cited

U.S. PATENT DOCUMENTS

| | | | | | |
|---|---|---|---|---|---|
| 1,374,956 | A | * | 4/1921 | Schneider | 229/123 |
| 3,147,856 | A | | 9/1964 | Lightner et al. | |
| 3,625,412 | A | | 12/1971 | Rosenburg | |
| 4,125,185 | A | * | 11/1978 | Bliss | 229/120.18 |
| 5,007,537 | A | * | 4/1991 | Ackeret | 206/232 |
| 5,078,268 | A | * | 1/1992 | Olson et al. | 206/232 |
| 5,103,972 | A | * | 4/1992 | Ackeret | 206/232 |
| 5,353,931 | A | * | 10/1994 | Antik | 206/232 |
| 5,513,752 | A | * | 5/1996 | Gottlieb | 229/120.18 |
| 5,860,589 | A | * | 1/1999 | Hsu | 206/232 |
| 5,944,183 | A | * | 8/1999 | Rowland et al. | 229/120.18 |
| 5,971,261 | A | * | 10/1999 | Grunfeld et al. | 229/153 |
| 6,070,719 | A | * | 6/2000 | Pollock | 206/232 |
| 6,702,108 | B2 | * | 3/2004 | Lo Duca | 229/120.18 |

FOREIGN PATENT DOCUMENTS

| | | |
|---|---|---|
| DE | 8020660 | 11/1980 |
| DE | 32 08 777 | 9/1983 |
| EP | 0 911 266 | 4/1999 |
| EP | 1 219 542 | 7/2002 |
| EP | 1321369 | 6/2003 |
| GB | 2 277 077 | 10/1994 |
| JP | 2000-296839 A * | 10/2000 |

OTHER PUBLICATIONS

U.S. Appl. No. 10/263,847, filed Oct. 4, 2002, Lo Duca.
U.S. Appl. No. 10/385,455, filed Mar. 12, 2003, Lo Duca.
U.S. Appl. No. 10/449,213, filed Jun. 2, 2003, Lo Duca.
U.S. Appl. No. 10/601,845, filed Jun. 24, 2003, Lo Duca.
U.S. Appl. No. 10/602,650, filed Jun. 25, 2003, Lo Duca.
U.S. Appl. No. 10/614,010, filed Jul. 8, 2003, Lo Duca.

* cited by examiner

*Primary Examiner*—Gary E. Elkins
(74) *Attorney, Agent, or Firm*—Oblon, Spivak, McClelland, Maier & Neustadt, P.C.

(57) ABSTRACT

A box, particularly suitable for containing packs of pharmaceutical products, which is formed from a single piece of cardboard and defines in its interior a pocket into which an illustrative leaflet or the like is inserted during the box manufacture. The box includes a projecting tab which covers, and is superposed on, the free end of the illustrative leaflet to prevent it interfering with the packs during their insertion into the box.

5 Claims, 3 Drawing Sheets

BOX WITH POCKET FOR EXTRACTABLE LEAFLET

FIELD OF THE INVENTION

The present invention relates to a box formed from a single piece of cardboard and defining in its interior a pocket into which, during the manufacture of the box, a leaflet can be inserted illustrating the product which is later to be inserted therein by the firm which uses the box.

BACKGROUND OF THE INVENTION

The term "illustrative leaflet" means any sheet, possibly folded several times on itself, carrying writing and instructions relative to the product contained in the box, or a card extractable from the pocket and having images or writing of any type reproduced on it.

Many articles are housed, preserved and transported in boxes or cases, normally of cardboard construction; very often, illustrative leaflets or the like are also inserted into these boxes. A frequent example is that in which the articles inserted into the boxes are containers of various kinds, bottles of various materials, or flat packs defining a plurality of recesses containing pharmaceutical products: in this latter case, the leaflet illustrating the pharmaceutical product must compulsorily be present in the actual box into which the bottle, container or the like is inserted.

In the usual known art, the boxes are produced by specialist firms, whereas the pharmaceutical industry directly provides for inserting the bottles or the like together with the relative illustrative leaflets into them: this operation is relatively laborious and slow, especially as a result of the difficulties encountered in inserting such leaflets (often of large dimensions and folded over several times) into the box in such a manner that they still allow the bottle or pack to be freely inserted without the leaflets becoming creased.

DESCRIPTION OF THE RELATED ART

To obviate these problems boxes have been proposed formed from a single piece of cardboard and defining in their interior a pocket into which the illustrative leaflet is inserted directly by the manufacturer of the box, the user of which has then merely to insert the articles (bottles or others) which the box is to contain.

Obviously, the leaflet must be retained inside each box such that it does not interfere with the article inserted into the box by the user.

GB-A-2277077 (see FIGS. 3 and 4) and DE-A-3208777 (see FIG. 2) describe boxes, into the interior of which there projects a freely rotatable flap which on one of its sides is rigid with one of the main side walls of the box, this flap facing a different main wall of the same box to form therewith a pocket housing the illustrative leaflet: these boxes cannot be used industrially because the flap which defines the pocket is connected to the box structure along only one of its sides, hence the flap can freely flex (or "open") towards the box interior, so preventing mechanical insertion thereinto of bottles or other packs of products to which the leaflet refers.

U.S. Pat. No. 3,147,856 (FIG. 3) and EP-A-0911266 (FIG. 2) describe boxes similar to those of the two aforementioned patents, but in which the flap defining the pocket in the box interior has its free end folded at 90° about itself to form a tab (indicated by the reference numeral 42 in U.S. Pat. No. 3,147,856 and by the numeral 16 in EP-A-0911266) which is glued to the adjacent main side wall of the box.

Other types of boxes have been proposed, such as that described in U.S. patent application Ser. No. 10/263,847 filed on Oct. 4, 2002, in which the supplementary panel defining in the box interior the pocket which is to contain the illustrative leaflet is retained in position by an appendix projecting from said panel and simply folded at a right angle to it to bear on the inside of one of the main lateral panels of the box.

Known boxes present the drawback that when the user firm inserts therein the articles which the boxes are to contain, using automatic machines operating at high speed, these articles interfere, at that box extremity or aperture through which the articles are inserted, with the illustrative leaflet or with the free edge of the supplementary panel defining the pocket provided therein, with evident serious operational consequences.

SUMMARY OF THE INVENTION

The main object of the present invention is to provide a box formed from a single piece of punched and crease-lined cardboard and having an internal pocket for housing an illustrative leaflet or the like, provided with elements which prevent the articles inserted into the box from interfering with the free edge of that panel defining the pocket and with the leaflet housed in the same pocket.

These and other objects are attained by a box having a panel folded into its interior to define a pocket for housing an illustrative leaflet or the like, characterised in that at least from that side of the panel defining said pocket which faces that end of the box through which articles to be contained therein are to be inserted, there projects a tab which is rotatable about a crease line provided in the panel, such that said tab can be turned outwards from the box to define a chute which facilitates the insertion of the articles into the box and prevents their interference with the panel defining the pocket and with the illustrative leaflet housed therein.

At least one hole is preferably provided in the panel defining said pocket to enable a portion of the illustrative leaflet housed in the box to be seen.

Again preferably, the box interior is accessible via a lid rotatable about a first folding line positioned at the level of the free edge of the adjacent ends of the box and also rotatable about a supplementary folding line, substantially parallel to the first line but spaced from it, to enable the lid and, with it, that portion of the main lateral panel of the box lying between said first and second folding line to be rotated outwards.

The invention also relates to the sheets in the form of a single piece of punched and crease-lined cardboard or the like, usable for forming boxes of the aforedefined type.

BRIEF DESCRIPTION OF THE DRAWINGS

The structure and features of the box will be more apparent from the ensuing description of one embodiment thereof given by way of non-limiting example with reference to the accompanying drawings, in which.

Figure 1:
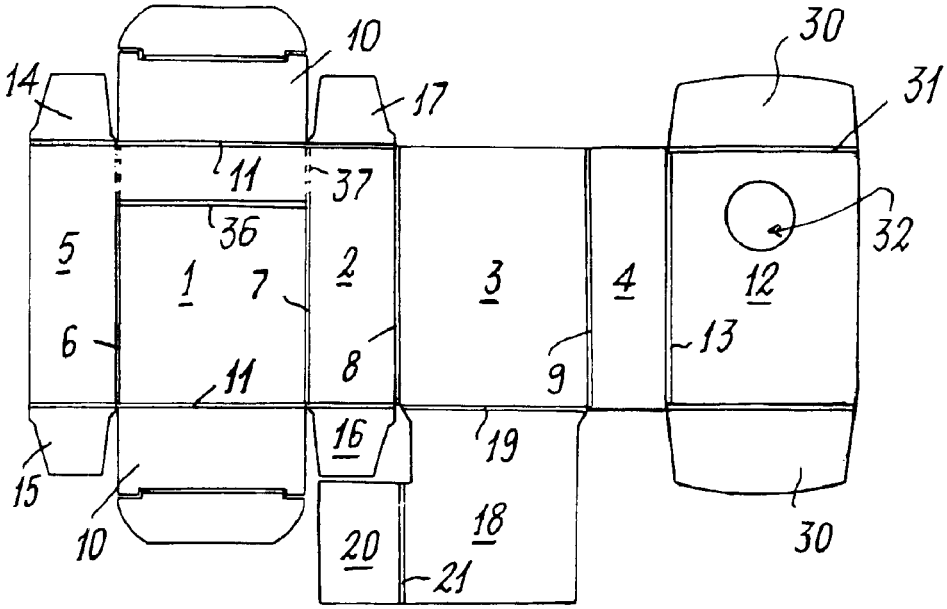
FIG. 1 is a plan view of a spread-out punched and crease-lined piece of cardboard usable for forming a box, the figure showing that surface of the cardboard which is to remain on the inside of the box.
Figure 6:
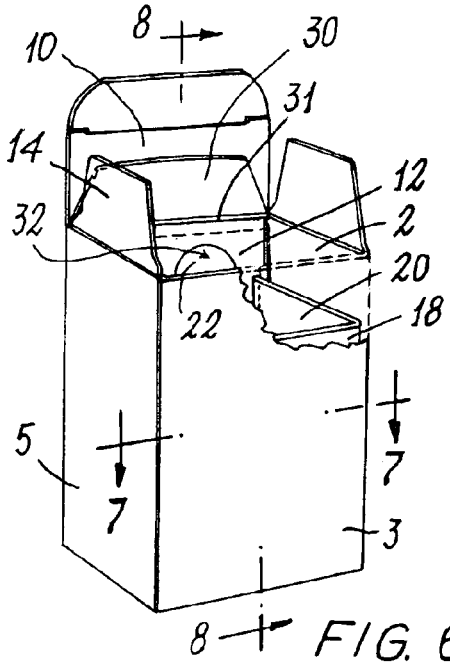
Figure 7:
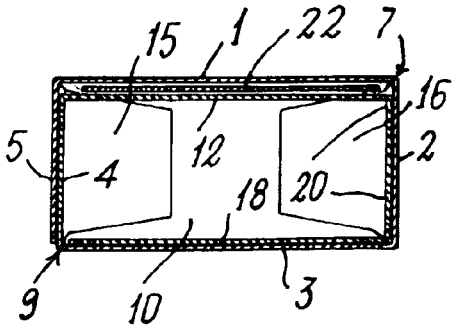
Figure 8:
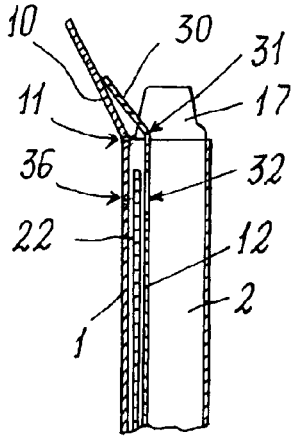

FIGS. from 2 to 5 show the piece of cardboard of FIG. 1 in its successive folding steps to form the box;

FIG. 6 is a perspective view of the finished box with its upper lid open, a portion of the box having been omitted to allow clearer vision of its interior;

FIG. 7 is a cross-section through the box on the line 7—7 of FIG. 6; and FIG. 8 is a longitudinal section through the open box on the line 8—8 of FIG. 6.

DETAILED DESCRIPTION OF THE INVENTION

Reference will firstly be made to FIG. 1, which shows a spread-out piece of punched, crease-lined and knurled cardboard seen from its inner side, i.e. the opposite side to that on which the descriptive matter which has to be visible on the outside of the finished box is printed.

The cardboard piece comprises four consecutive main panels 1–4 and a flap 5 projecting from the first of the main panels, i.e. from the panel 1; the said panels and flap are separated one from another by longitudinal parallel folding lines 6–9. From the two opposite ends of the main panel 1 there project two closure panels 10 (separated from the main panel by transverse folding lines 11 perpendicular to the longitudinal folding lines 6–9) intended to form the lid and respectively the base of the box, whereas from opposing sides of the flap 5 and main panel 2 there project closure flaps 14–17.

From the last of the main panels, i.e. from the panel 4, there projects an end panel 12 separated from said panel 4 by a longitudinal folding line 13 parallel to the lines 6–9. From the drawings it can also be seen that the total width of the end panel 12 is substantially equal to or slightly less than the width of the two main panels 1 and 3, whereas its length is substantially equal.

From the upper and lower ends of the panel 12 there project two tabs 30 separated from the panel 12 by folding lines (crease lines) 31. In the same panel 12 there is also provided a hole 32 (more than one could be provided) as specified hereinafter.

From the penultimate main panel 3 there downwardly (with respect to FIG. 1) projects a supplementary panel 18 separated therefrom by a folding line 19 transverse to the longitudinal folding lines 6–9 and 13, from said supplementary panel 18 there projecting (towards the first main panel 1, i.e. towards the left in FIG. 1) a tab 20 separated therefrom by a folding line 21 which is also longitudinal.

Finally it can be seen from the drawings that in the panel 1 there is provided a supplementary folding line 36 close to the folding line 11 which separates it from that closure panel 10 higher in the drawings, and that the crease lines 6 and 7 present cuts 37 between the crease lines 11 and 36.

It will now be assumed that the cardboard processing firm which has produced the punched and crease-lined cardboard sheet of FIG. 1 then folds it in order to form from it the box to be despatched to the box user.

Figure 2:
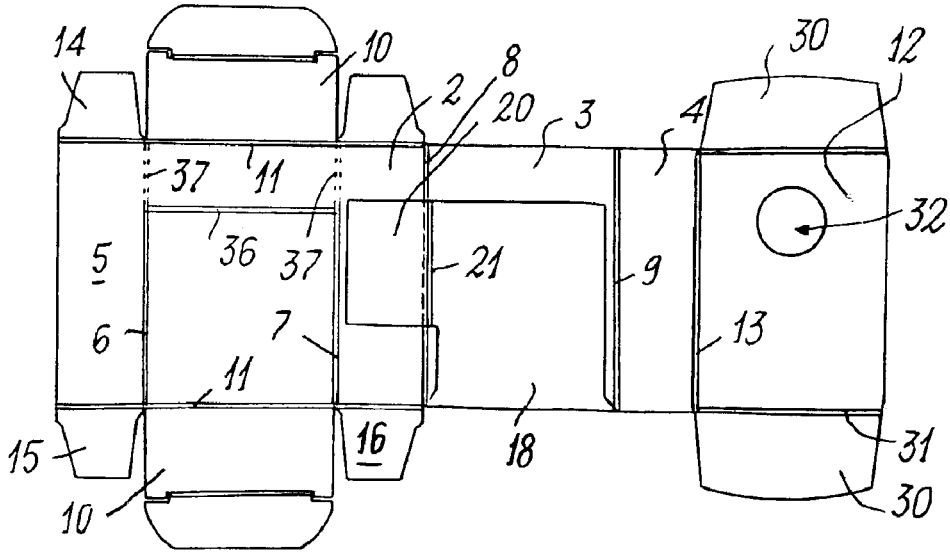
Figure 3:
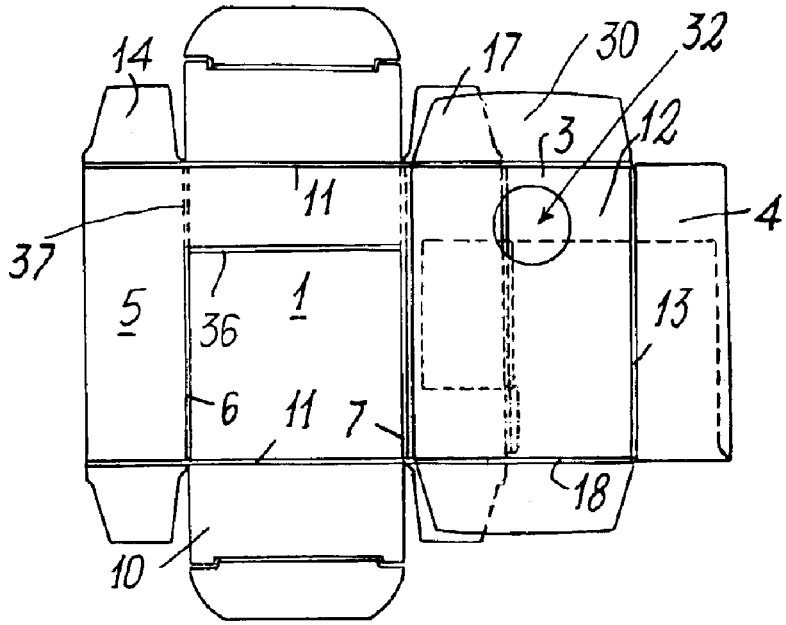
Figure 4:
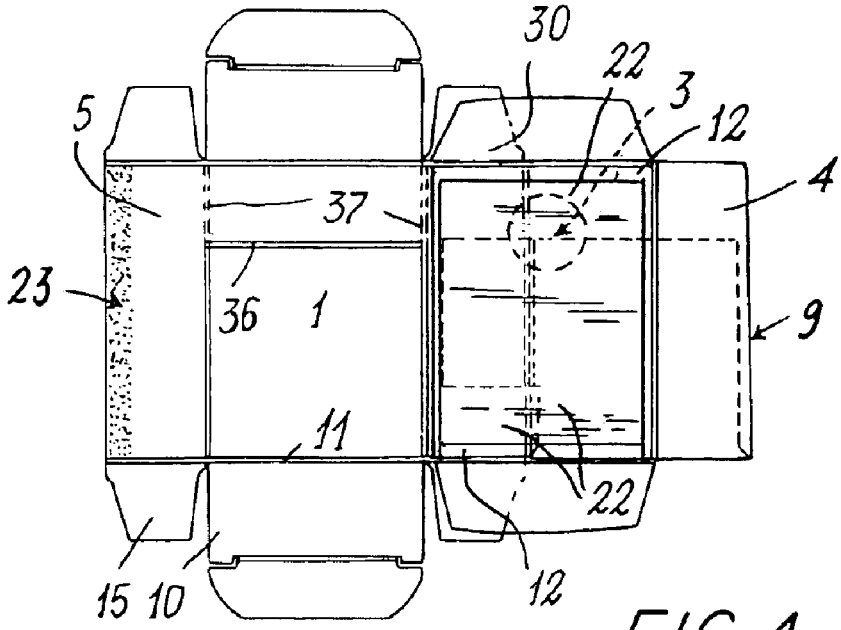
Figure 5:
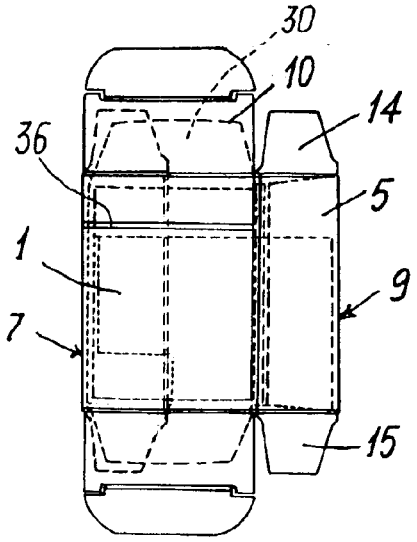

In a first step, the supplementary panel 18 together with the tab 20 are folded (by rotating them about the folding line 19) onto the penultimate main panel 3 and, respectively, onto the main panel 2 which is adjacent to the panel 3 and positioned (with respect thereto) towards the first panel 1, as shown FIG. 2. The main panel 4 together with the end panel 12 are then folded about the folding line 9 onto the supplementary panel 18 and tab 20 (FIG. 3), after which an illustrative leaflet 22—previously printed and possibly folded on itself (if the leaflet is required to be folded) is (always automatically) rested on the upper surface of the end panel 12 and one or more lines of glue 23 are applied to the panel 5 (FIG. 4), then finally the main panel 1 (and with it the flap 5) is folded about the folding line 7 so that the panel 1 lies superposed on the leaflet 22 and on the underlying end panel 12, whereas the flap 5 lies superposed on the main panel 4 onto which it is fixed by the line of glue 23 (FIG. 5). Under these conditions the leaflet 22 is housed and retained in a pocket defined by the end panel 12 and the main panel 1.

All the aforedescribed operations can be effected easily at high speed by those cardboard processing firms who produce traditional boxes, employing those automatic machines commonly used by said firms.

The user firm which receives the box already glued and folded as shown in FIG. 5 then uses its automatic machines of normal use to shape the box by closing the final panel, but leaving the upper closure panel 10, the upper tab 30 and the flaps 14 and 17 raised, i.e. open and folded outwards from the box (as shown in detail in the longitudinal section of FIG. 8 which clearly shows the attitude assumed by the upper end of the box), then inserts into the box the article which it is to contain.

It is of the maximum importance to note that, by virtue of the aforedescribed structure, the upper panel 10 and the upper tab 30 of the open box (FIG. 8) form a chute which facilitates the insertion of the said article into the box, while preventing the article interfering with the upper edge of the panel 12 and of the illustrative leaflet 22, which is thus securely protected within the box.

A portion of the leaflet (for example that portion on which the product identification bar codes are printed) enclosed in the box is visible through the hole 22 in the panel 12.

As the introduction into the box of a bottle or other article can be done at high speed with known machines, it is obvious that the user firm normally will not have to take particular care to prevent the bottle or other product (when being inserted into the box) from interfering with the leaflet or with the upper edge of the panel 12.

It need merely be added that the presence of the tab 20 of the supplementary panel 18 ensures that the pocket housing the leaflet maintains constant shape and dimensions, even without the need to apply layers of glue other than the already stated single layer of glue 23.

After the desired article has been inserted into the box, the upper box aperture is closed in the traditional manner with traditional machines. When the upper panel 10 is closed by rotation about its crease line 11, it automatically causes the tab 30 to turn about its crease line 31.

When the leaflet 22 is to be withdrawn from the box, the box upper panel 10 is raised (i.e. opened) and the panel 1 is torn along the two knurlings 37 (achieved by simply pulling the panel 10 outwards), after which the upper part of the panel 1 is turned about the crease line 36 to hence leave the leaflet 22 exposed, enabling it to be easily gripped by two fingers and be extracted from the box, into which it can be again inserted and the box be re-closed.

I claim:

1. A box having a panel folded into an interior of the box to define a pocket for housing an illustrative leaflet, wherein at least from a side of the panel defining said pocket which faces an end of the box through which articles be contained therein are to be inserted, there projects a tab which is rotatable about a crease line provided in the panel, such that said tab can be turned outwards from the box to define a chute which facilitates insertion of the articles into the box and prevents interference of the articles with the panel defining the pocket and with the illustrative leaflet housed therein.

2. The box as claimed in claim 1, wherein at least one hole is provided in the panel defining said pocket to enable a portion of the illustrative leaflet housed in the box to be seen.

3. The box as claimed in claim 1, wherein the box interior is accessible via a lid rotatable about a first folding line positioned at a level of a free edge of adjacent ends of the box and also rotatable about a supplementary folding line, substantially parallel to the first line but spaced from the first line, to enable the lid and a portion of a main lateral panel of the box lying between said first and supplementary folding lines to be rotated outwards.

4. The box as claimed in claim 2, wherein the box interior is accessible via a lid rotatable about a first folding line positioned at a level of a free edge of adjacent ends of the box and also rotatable about a supplementary folding line, substantially parallel to the first line but spaced from the first line, to enable the lid and a portion of a main lateral panel of the box lying between said first and supplementary folding lines to be rotated outwards.

5. A box formed from a single piece of punched and crease-lined cardboard, defining an internal pocket for containing an extractable leaflet, comprising:

at least four consecutive main panels, a flap which projects from the first main panel and is superposed on and glued to the last main panel in the finished box, an end panel which projects from the last main panel and has a width substantially equal to that of the first main panel, which the end panel faces in the box interior to form with said first panel a pocket for containing said leaflet, at least one panel for closing at least one end of the box, the main panels, the end panel and said flap being separated one from the other by parallel longitudinal folding lines, in which:

from a penultimate main panel there projects a supplementary panel separated from the penultimate main panel by a folding line transverse to said longitudinal folding lines, from said supplementary panel there projecting a tab separated from the supplementary panel by a likewise longitudinal folding line, the supplementary panel and the tab projecting from the supplementary panel being folded into the box interior about their folding lines such that the supplementary panel and respectively said tab are superposed on the penultimate main panel and respectively on one of the main panels adjacent to the penultimate main panel on a side towards the first panel, the main panels and also the end panel being folded about their longitudinal folding lines such that the end panel becomes superposed on the first main panel in the box interior to form therewith said pocket, while a free longitudinal edge of the end panel rests on a free longitudinal edge of the tab of the supplementary panel, which supports the end panel to prevent the end panel from flexing towards the interior of the box, wherein at least from a side of the panel which faces an end of the box through which articles to be contained therein are to be inserted, there projects a tab which is rotatable about a crease line provided in the same panel, such that said tab can be turned outwards from the box to define a chute which facilitates the insertion of the articles into the box and prevents their interference with the panel defining the pocket and with the illustrative leaflet housed therein.

* * * * *